United States Patent [19]

Patel et al.

[11] Patent Number: 4,799,464

[45] Date of Patent: Jan. 24, 1989

[54] BOAT-TYPE ROCKER ARM ASSEMBLY

[75] Inventors: Ramanlal L. Patel, Minnetonka, Minn.; Meng-Sang Chew, Virginia Beach, Va.; Richard A. Marsh, Birmingham, Mich.; Richard C. Rosenberg, Romeo, Mich.; Henry Thomas, Jr., Grosse Pointe Woods, Mich.

[73] Assignees: Toledo Stamping & Manufacturing Company, Toledo, Ohio; General Motors Corporation, Detroit, Mich.

[21] Appl. No.: 471,756

[22] Filed: Mar. 3, 1983

[51] Int. Cl.[4] ..... F01L 1/18

[52] U.S. Cl. ..... 123/90.41

[58] Field of Search ..... 123/90.39, 90.41, 90.42; 308/2 R

[56] References Cited

U.S. PATENT DOCUMENTS

| | | | |
|---|---|---|---|
| 1,497,451 | 6/1924 | Kytlica | 123/90.41 |
| 2,943,612 | 7/1960 | Middler | 123/90.41 |
| 3,289,657 | 12/1966 | Winter, Jr. | 123/90.41 X |
| 3,614,943 | 10/1971 | Schley | 123/90.42 |
| 3,667,434 | 6/1972 | Sandusky | 123/90.41 X |
| 4,314,732 | 2/1982 | Murphy | 123/90.41 X |
| 4,393,820 | 7/1983 | Maki et al. | 123/90.41 |
| 4,543,920 | 10/1985 | Bonvallet | 123/90.43 |

*Primary Examiner*—Michael Koczo
*Assistant Examiner*—Peggy Neils
*Attorney, Agent, or Firm*—Allen D. Gutchess, Jr.

[57] ABSTRACT

A low-friction, boat-type rocker arm assembly is provided. The boat-type rocker arm is designed to roll on a fulcrum of a supporting pedestal during operation, rather than slipping or sliding thereon. The rocker arm has a recessed intermediate area of a predetermined radius which is greater than the radius of the fulcrum of the pedestal. The rocker has a rectangular opening in the recessed portion with opposite, transverse edges tapering downwardly and inwardly which fit closely with the pedestal to limit travel of the rocker arm relative to the pedestal. The pedestal also has rounded surfaces at those portions positioned near the tapered edges of the rocker arm opening.

19 Claims, 2 Drawing Sheets

BOAT-TYPE ROCKER ARM ASSEMBLY

This invention relates to a low-friction, boat-type rocker arm assembly.

Boat-type rocker arm assemblies are well known in the art as shown, for example, in U.S. Pat. Nos. 3,614,943 issued Oct. 26, 1971 and 3,667,434 issued June 6, 1972. The boat-type rocker arms are mounted on pedestals and, heretofore, such rocker arms have had sliding contact with fulcrums of the pedestals on which they are mounted.

The present invention provides a boat-type rocker arm assembly in which the rocker arm has a rolling motion relative to the fulcrum of a pedestal on which the rocker arm is mounted. This rolling motion results in less friction with concomitant less wear and improved fuel economy.

The new rocker arm has a recessed intermediate area of generally semi-cylindrical shape with a rectangular opening centrally located in the recessed area. This opening has transverse, parallel edges which taper downwardly and inwardly. The supporting pedestal of the new rocker arm assembly has a fulcrum or head with downwardly facing surfaces of generally semi-cylindrical shape but with a radius smaller than the radius of the intermediate portion of the rocker arm. The supporting pedestal has a shank extending through the rectangular opening of the rocker arm with the dimension across the shank being slightly less than the distance between the transverse edges of the opening. The cooperation of the pedestal and the rocker arm opening limit travel of the rocker arm longitudinally on the pedestal. Preferably, the portion of the predestal shank located at the rectangular opening has rounded surfaces adjacent the tapered opening edges to enable clearance between the pedestal and the opening to be further reduced.

It is, therefore, a principal object of the invention to provide a boat-type rocker arm assembly resulting in lower friction during operation.

Another object of the invention is to provide a boat-type rocker arm assembly in which a fulcrum of a supporting pedestal of the assembly has a smaller radius than a corresponding intermediate portion of the rocker arm which it contacts.

A further object of the invention is to provide a boat-type rocker arm assembly in which the rocker arm has a rectangular opening in an intermediate portion with transverse edges which taper downwardly and inwardly.

Yet another object of the invention is to provide a boattype rocker arm assembly in which the rocker arm has a rectangular opening with transverse edges tapering downwardly and inwardly and a supporting pedestal has a shank with opposite, rounded surfaces positioned adjacent the transverse edges of the opening.

Other objects and advantages of the invention will be apparent from the following detailed description of a preferred embodiment thereof, reference being made to the accompanying drawings, in which.

Figure 1:
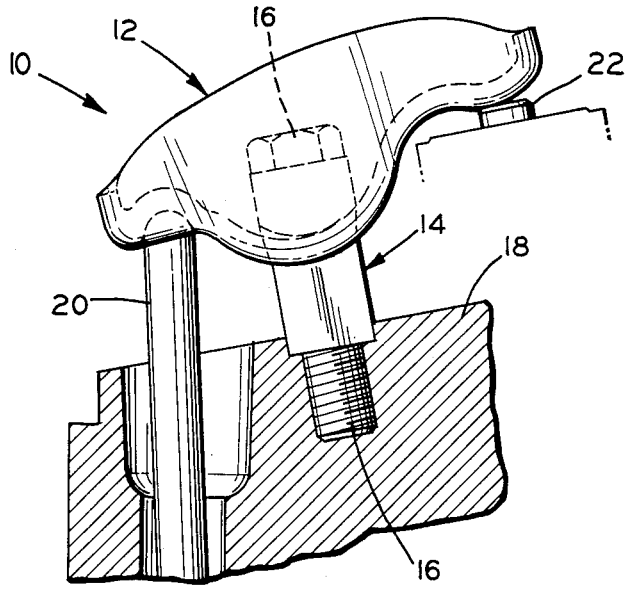
FIG. 1 is a somewhat schematic side view in elevation of a rocker arm assembly in accordance with the invention mounted on an engine shown in section.

Referring particularly to FIG. 1, a rocker arm assembly in accordance with the invention is indicated at 10 and includes a boat-type rocker arm 12 mounted on a supporting pedestal 14. A suitable threaded fastener 16 extends through the pedestal 14 and mounts the assembly on an engine block 18. One end of the rocker arm 10 engages the upper end of a push rod 20 and the other end engages the upper end of a valve stem 22, in a known manner.

Figure 2:
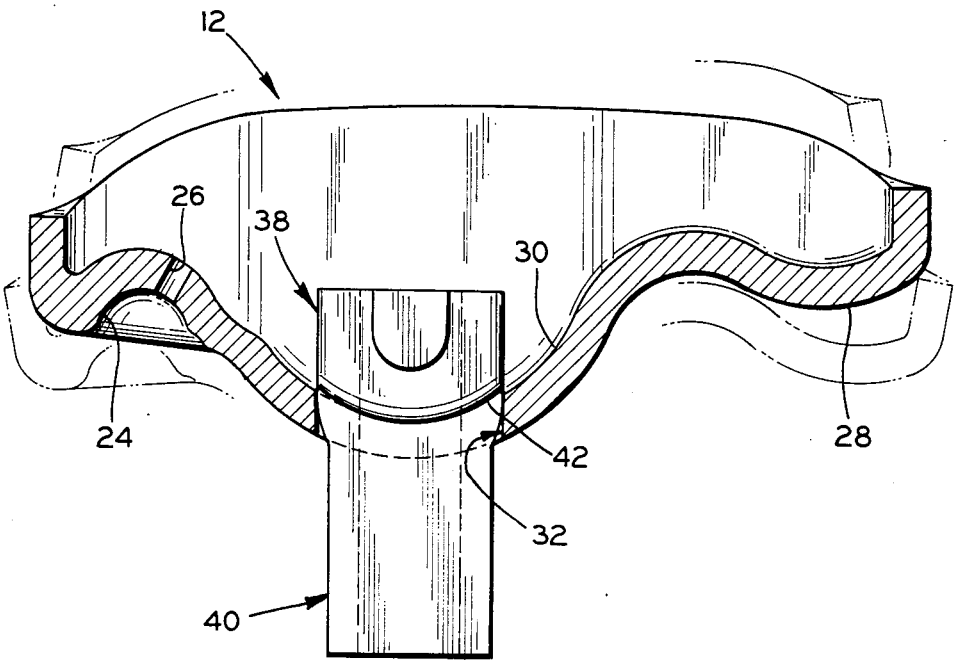
FIG. 2 is an enlarged view in longitudinal cross section taken through the rocker arm assembly of FIG. 1 with extreme positions of the rocker arm shown in dotted lines.
Figure 3:
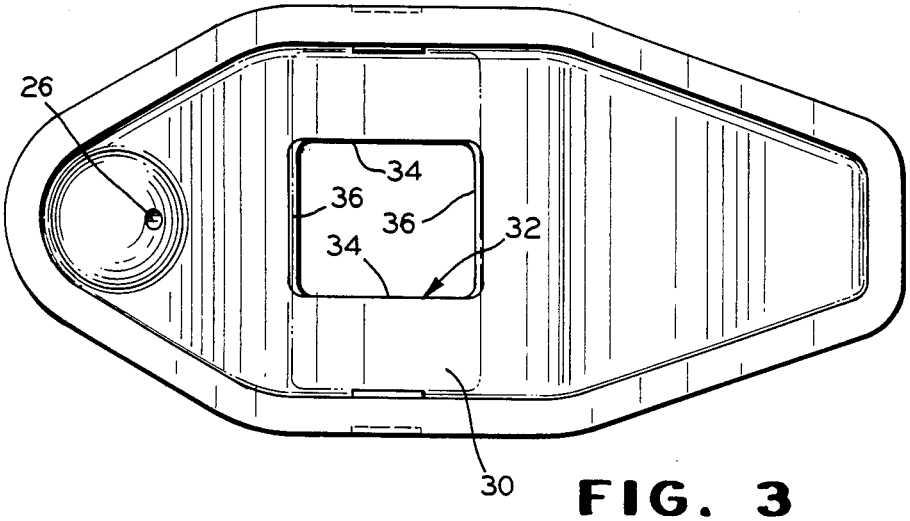
FIG. 3 is a top view of the rocker arm.
Figure 4:
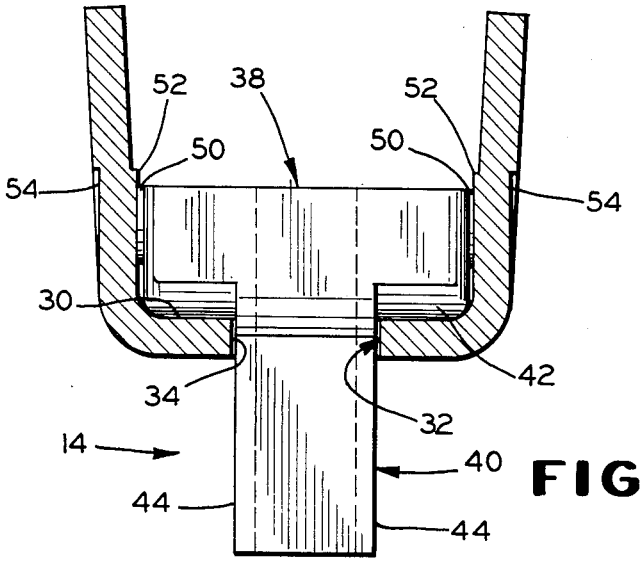
FIG. 4 is a view in transverse cross section taken through the rocker arm assembly.
Figure 5:
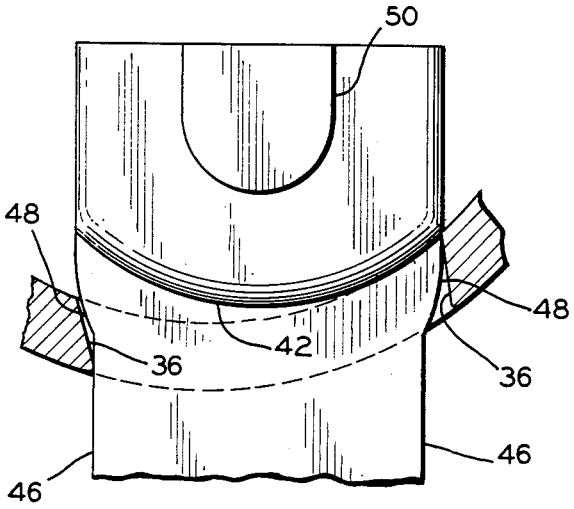
FIGS. 5 and 6 are greatly enlarged, fragmentary views of the rocker arm and supporting pedestal, with the rocker arm shown in the extreme tilted positions.
Figure 6:
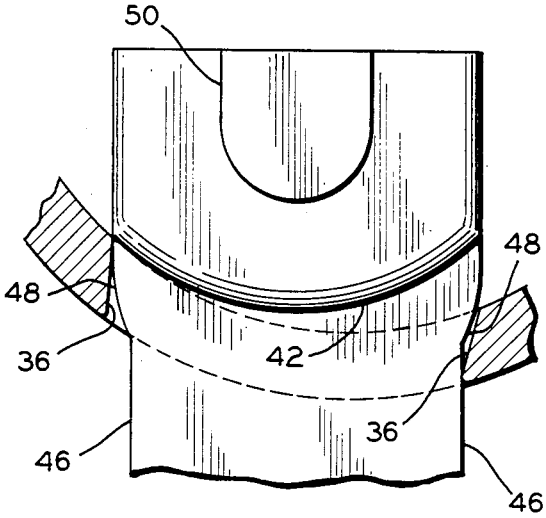

Referring more particularly to FIG. 2, the rocker arm has a concave recess 24 which receives the upper end of the push rod 20 with a lubricating hole 26 communicating with the recess 24 and with the interior of the rocker arm. The other end of the rocker arm has a convex surface 28 which engages the upper end of the valve stem 22. An intermediate portion of the rocker arm has a recessed area of surface 30, which as shown is of generally semi-cylindrical shape. As also shown in FIGS. 3 and 4, the recess 30 has a centrally located rectangular opening 32 therein which has longer longitudinally-extending side edges 34 and shorter transverse edges 36. As best shown in FIGS. 5 and 6, the transverse edges 36 taper downwardly and inwardly with the angle of taper depending on the extent to which the rocker arm pivots during operation. The included angle between the tapered edges and the axis of the pedestal 14, when the arm 12 is in a middle position, can be from 3° to 15°, and preferably from 4° to 8°.

The pedestal 14 in accordance with the invention basically includes a fulcrum or head 38 and a shank 40. The fulcrum 38 extends transversely beyond both sides of the shank 40 and has lower, downwardly-extending surfaces 42 of a predetermined radius which is less than the radius of the recessed surface 30 of the rocker arm 12. Preferably, the fulcrum radius is from 15% to 35% less than the radius of the surface 30. For example, in one arm, the radius of the surface 30 is 0.600 inch while the radius of the surfaces 42 is 0.475 inch. The surface 30 of the intermediate portion of the arm can even be flat, having an infinite radius. However, in practice it is hard to maintain a reasonably precise degree of flatness and the arm 12 is more apt to twist during operation. In addition, the substantially line contact area between the surfaces 42 and 30 would be even narrower and possibly cause greater wear.

The shank 40 of the pedestal 14 is of rectangular cross section similar to that of the opening 32. The shank has wider sides 44, the distance across which is slightly less than the distance across the longitudinal edges 34 of the opening 32. The shank 40 also has narrower; transverse sides 46, the distance between which is slightly less than the distance between the transverse edges 36 of the opening 32.

The upper portions of the shank sides 46 which extend through the opening 32 near the fulcrum 38 extend outwardly to rounded surfaces 48 which, as shown, meet the sides of the fulcrum 38. The rounded surfaces 48 are spaced such as to fit closely with the tapered edges 36 of the opening 32 so as to be substantially in sliding contact therewith. In this manner longitudinal travel of the boat-type rocker arm 12 relative to the pedestal 14 during operation of the rocker arm assembly 10 is substantially eliminated. The shank contacts the transverse edges 36 of the opening 32 at the extreme angular positions of the arm 12, as shown in FIGS. 5 and 6, to limit the angular movement thereof. The center of the radius for each of these shank surfaces 48 is located above the shank 14 and within the transverse shape defined by the fulcrum 38.

To prevent transverse movement to any extent of the pedestal 14 relative to the rocker arm 12, the ends of the fulcrum 38 have shallow projections 50 which cooperate with shallow, inwardly-extending projections 52 formed in the sides of the rocker arm 12. The latter are preferably formed by a coining operation, which produces shallow dimples 54 on the outside surfaces of the rocker arm sides. The surfaces of the projections 52 are essentially parallel to one another whereas the upper sides of the rocker arm taper outwardly to facilitate assembly of the rocker arm and the pedestal.

Various modifications of the above-described embodiment of the invention will be apparent to those skilled in the art, and it is to be understood that such modifications can be made without departing from the scope of the invention, if they are within the spirit and the tenor of the accompanying claims.

I claim:

1. A boat-type rocker arm assembly comprising a pedestal having a fulcrum and a shank of generally rectangular shape in transverse cross section, said fulcrum extending outwardly beyond two opposite sides of said shank, said fulcrum having curved lower surfaces of a predetermined radius, an elongate boat-type rocker arm having a curved intermediate interior surface extending thereacross between its ends, said interior surface having a radius greater than the radius of said fulcrum, said interior surface being straight as viewed in cross section taken perpendicular to the longitudinal extent of said rocker arm, whereby said lower surfaces of said fulcrum engage said interior surface on substantially line contact extending perpendicular to the longitudinal extent of said rocker arm, said rocker arm having a rectangular opening centrally located in the intermediate surface through which said shank of said pedestal extends, said rectangular opening having transverse edges extending across said rocker arm and tapering downwardly and inwardly, said pedestal having opposite curved areas, as viewed in longitudinal section through said shank, on the other two opposite sides of said shank at the portions thereof which extend through said rectangular opening, the dimension between said opposite curved areas being slightly less than the corresponding dimension across said opening between said transverse edges, whereby the cooperation of said rectangular opening and said pedestal substantially prevents longitudinal movement of said rocker arm relative to said pedestal.

2. a boat-type rocker arm assembly comprising a pedestal having a fulcrum and a shank of generally rectangular shape in transverse cross section, said fulcrum extending outwardly beyond two opposite sides of said shank, said fulcrum having curved lower surfaces of a predetermined radius, an elongate boat-type rocker arm having a curved intermediate interior surface extending thereacross between its ends, said interior surface having a radius greater than the radius of said fulcrum, said interior surface being straight as viewed in cross section taken perpendicular to the longitudinal extent of said rocker arm, whereby said lower surfaces of said fulcrum engage said interior surface on substantially line contact extending perpendicular to the longitudinal extent of said rocker arm, said rocker arm having an opening centrally located in the intermediate surface through which said shank of said pedestal extends, said opening having transverse edges extending across said rocker arm, said pedestal having opposite curved areas, as viewed in longitudinal section through said shank, at the portion thereof extending through said opening, the dimension between said opposite curved areas being slightly less than the corresponding dimension across said opening between said transverse edges, whereby the cooperation of said opening and said pedestal substantially prevents longitudinal movement of said rocker arm relative to said pedestal.

3. A boat-type rocker arm assembly comprising a pedestal having a fulcrum and a shank of generally rectangular shape in transverse cross section, said fulcrum extending outwardly beyond two opposite sides of said shank, said fulcrum having curved lower surfaces of a predetermined radius, an elongate boat-type rocker arm having a curved intermediate interior surface extending thereacross between its ends, said interior surface having a radius greater than the radius of said fulcrum, said interior surface being straight as viewed in cross section taken perpendicular to the longitudinal extent of said rocker arm, whereby said lower surfaces of said fulcrum engage said interior surface on substantially line contact extending perpendicular to the longitudinal extent of said rocker arm, said rocker arm having a rectangular opening centrally located in the intermediate surface through which said shank of said pedestal extends, said rectangular opening having transverse edges tapering downwardly and inwardly, the dimension between the other two opposite sides of said shank at the portion extending through said rectangular opening being slightly less than the corresponding dimension across said opening, whereby the cooperation of said rectangular opening and said pedestal substantially prevents longitudinal movement of said rocker arm relative to said pedestal.

4. A rocker arm according to claim 2 wherein said curved areas of the said shank have equal radii which have a common center located above the said shank and within the transverse shape defined by said fulcrum.

5. A boat-type rocker arm assembly according to claim 1 characterized by the included angle between said tapered edges and the axis of said pedestal, when said arm is in a middle position, being from 3° to 15°.

6. A boat-type rocker arm assembly according to claim 1 characterized by the included angle between said tapered edges and the axis of said pedestal, when said arm is in a middle position, being from 4° to 8°.

7. A boat-type rocker arm assembly according to claim 1 characterized by the radius of said fulcrum being from 15% to 35% less than the radius of said intermediate surface.

8. A boat-type rocker arm assembly according to claim 1 characterized by the length of said transverse edges of said rectangular opening being shorter than the length of longitudinal edges of said rectangular opening.

9. A boat-type rocker arm assembly according to claim 1 characterized by said curved areas of said pedestal being substantially in sliding contact with said transverse edges of said rectangular opening during rocking movement of said rocker arm.

10. A boat-type rocker arm assembly according to claim 2 characterized by the radius of said fulcrum being from 15% to 35% less than the radius of said intermediate surface.

11. A boat-type rocker arm assembly according to claim 2 characterized by said curved areas of said pedestal being substantially in sliding contact with the adjacent edges of said opening during rocking movement of said rocker arm.

12. A boat-type rocker arm assembly according to claim 2 characterized by said rocker arm opening being rectangular and said transverse edges tapering downwardly and inwardly.

13. A boat-type rocker arm assembly according to claim 12 characterized by the included angle between said tapered edges and the axis of said pedestal, when said rocker arm is in a middle position, being from 3° to 15%.

14. A boat-type rocker arm assembly according to claim 3 characterized by the included angle between said tapered edges and the axis of said pedestal, when said arm is in a middle position, being from 3° to 15°.

15. A boat-type rocker arm assembly according to claim 14 characterized by the included angle between said tapered edges and the axis of said pedestal, when said arm is in a middle position, being from 4° to 8°.

16. A boat-type rocker arm assembly according to claim 3 characterized by the radius of said fulcrum being from 15% to 35% less than the radius of said intermediate surface.

17. A boat-type rocker arm assembly according to claim 3 characterized by the length of said transverse edges of said rectangular opening being shorter than the length of longitudinal edges of said rectangular opening.

18. A boat-type rocker arm assembly according to claim 3 characterized by said pedestal having opposite curved areas, as viewed in longitudinal section through said shank, at the sides thereof extending through said opening near the transverse edges.

19. A boat-type rocker arm assembly according to claim 18 characterized by said curved areas of said pedestal being substantially in sliding contact with said transverse edges of said rectangular opening during rocking movement of said rocker arm.

* * * * *

UNITED STATES PATENT AND TRADEMARK OFFICE

CERTIFICATE OF CORRECTION

PATENT NO. : 4,799,464

DATED : January 24, 1989

INVENTOR(S) : Ramanlal L. Patel et al

It is certified that error appears in the above-identified patent and that said Letters Patent is hereby corrected as shown below:

Column 1, line 34, change "predestal" to --pedestal--.

Column 1, line 53, change "boattype" to --boat-type--.

Column 2, line 56, change ";" to --,--.

Column 3, line 56, claim 2, line 1, change "a" (first occurrence) to --A--.

Column 5, line 16, claim 13, line 5, change "15%" to --15°--.

Signed and Sealed this

Eighteenth Day of July, 1989

*Attest:*

DONALD J. QUIGG

*Attesting Officer*

*Commissioner of Patents and Trademarks*